US010040604B2

(12) United States Patent
Baldo et al.

(10) Patent No.: US 10,040,604 B2
(45) Date of Patent: Aug. 7, 2018

(54) PLASTIC CONTAINER WITH INTEGRAL HANDLES

(71) Applicant: S.I.P.A. Societa' Industrializzazione Progettazione E Automazione S.P.A., Vittorio, Veneto (IT)

(72) Inventors: Elena Baldo, Vittoria Veneto (IT); Paolo Tadiotto, Vittoria Veneto (IT); Dino Enrico Zanette, Godega di Sant'urbano (IT); Matteo Zoppas, Conegliano (IT)

(73) Assignee: S.I.P.A. Societa' Industrializzazione Progettazione E Automazione S.p.A., Vittorio, Veneto (IT)

( * ) Notice: Subject to any disclaimer, the term of this patent is extended or adjusted under 35 U.S.C. 154(b) by 123 days.

(21) Appl. No.: 15/308,071

(22) PCT Filed: May 5, 2015

(86) PCT No.: PCT/EP2015/059849
§ 371 (c)(1),
(2) Date: Oct. 31, 2016

(87) PCT Pub. No.: WO2015/169799
PCT Pub. Date: Nov. 12, 2015

(65) Prior Publication Data

US 2017/0066555 A1 Mar. 9, 2017

(30) Foreign Application Priority Data

May 5, 2014 (IT) ..... RM2014A0222

(51) Int. Cl.
*B65D 23/10* (2006.01)
*B65D 1/02* (2006.01)
*B65D 1/20* (2006.01)
*B67D 3/00* (2006.01)

(52) U.S. Cl.
CPC ..... *B65D 23/102* (2013.01); *B65D 1/023* (2013.01); *B65D 1/0276* (2013.01); *B65D 1/20* (2013.01); *B67D 3/0067* (2013.01)

(58) Field of Classification Search
CPC ..... B65D 23/102; B65D 1/023
See application file for complete search history.

(56) References Cited

U.S. PATENT DOCUMENTS 3,225,950 A * 12/1965 Fulcher ..... B65D 1/0223 215/384
4,805,808 A * 2/1989 Larson ..... B65D 23/10 215/383
4,892,207 A * 1/1990 Cullis ..... B65D 23/104 215/10

(Continued)

FOREIGN PATENT DOCUMENTS

AT 506165 6/2009
WO WO9503977 2/1995

*Primary Examiner* — Stephen Castellano
(74) *Attorney, Agent, or Firm* — Stetina Brunda Garred & Brucker

(57) ABSTRACT

A large container (100) for a water dispenser having side handles (8) formed as recesses in the side wall of the container (100) and bottom handles (9) formed as recesses in the central portion of the bottom (3) of the container (100). The side handles (8) and the bottom handles (9) are provided for facilitating the lifting and the transport.

10 Claims, 6 Drawing Sheets

(56) References Cited

U.S. PATENT DOCUMENTS

| | | | | |
|---|---|---|---|---|
| 6,053,345 | A | 4/2000 | Jones | |
| 6,273,282 | B1 | 8/2001 | Ogg et al. | |
| 6,832,705 | B2 * | 12/2004 | Hollander | B65D 23/10 222/465.1 |
| 7,487,883 | B2 * | 2/2009 | Waters | B65D 1/0276 215/398 |
| 2005/0211662 | A1 | 9/2005 | Eaton et al. | |
| 2007/0235462 | A1 | 10/2007 | Omdoll et al. | |
| 2008/0000867 | A1 * | 1/2008 | Lane | B65D 1/0223 215/10 |
| 2009/0266782 | A1 | 10/2009 | Lane | |

* cited by examiner

PLASTIC CONTAINER WITH INTEGRAL HANDLES

CROSS REFERENCE TO RELATED APPLICATIONS

The present application is the national stage (Rule 371) of international application No. PCT/EP2015/059849 filed on May 5, 2015. The present application claims priority to PCT International Application No. PCT/EP2015/059849 filed on May 5, 2015, which application claims priority to Italian Patent Application No. RM2014A000222 filed May 5, 2014, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to large water containers, more specifically to water containers for use in connection with water dispensers.

STATE OF THE ART

Water dispensers are familiar items in offices and factories and provide a convenient and readily available source of drinking water. Water dispensers generally utilize replaceable bottled water containers made of polymeric material such as polycarbonate, PET, etc. These containers, are usually supplied in the form of relatively large, heavy bottles of drinking water which must be transported to the site, stored and manipulated into position in the water dispenser. To replenish the container a new container has to be removed from the racks by the neck and is usually placed on the shoulder of the person delivering the container. Even to place the container on the dispenser results to be cumbersome. These containers can contain between 12-25 liters of water resulting particularly heavy. One of the drawbacks of water dispensers of the type which utilizes this type of water container, or bottle, is in fact the degree of difficulty in handling the replacement containers. Certain producers have inserted a vertical handle and the majority of times this handle is inserted in the blowing mold. A vertical handle aids in the transport of the container but is awkward in lifting the container from the ground and placing it on the dispenser. It would be helpful to provide a more manageable bottled water container for water dispenser that could help in facilitating these movements, while at the same time enabling increased strength and economy in such replaceable containers for a more widespread use of water dispenser which utilize these type of containers.

As mentioned, the handling of a water container for water dispensers, which has a weight above 10 kg, typically well above 10 kg, is cumbersome. The state of the art does not disclose nor suggest any solution to make it easier to handle a container, weighting about 10 kg or more, which can be lifted and placed on a water dispenser with two hands.

BRIEF SUMMARY OF THE INVENTION

An object of the present invention is to overcome the aforementioned drawbacks providing a water container, or bottle, for water dispensers, that is easy to transport and to handle particularly when it has to be removed from the rack, transported and placed on the dispenser. Another object of the present invention is to provide a container for water dispensers having gripping handles that can facilitate the insertion of a hand but also the flow of liquid during the washing cycles in order not to permit the proliferation of microorganisms. Another object of the present invention is to provide a container that has integral side and bottom handles which are formed during the blowing process of the production of the water container for dispenser. The above objects and advantages are attained by the present invention by providing, according to claim 1, a thermoplastic material container for a water dispenser, defining a longitudinal axis Z, comprising:

- a neck,
- a body having a side wall,
- at least two side handles arranged opposite to each other with respect to the longitudinal axis Z, each formed as a recess in said side wall having a surface proximal to the neck substantially transversal to the longitudinal axis Z, each adapted to accommodate the fingers of a hand of a user, to lift the container vertically,
- a bottom closing the container at its lower end, defining a base plane, comprising
- a peripheral portion forming a planar base,
- a central portion reentrant with respect to the peripheral portion, and;
- at least one base handle formed as a recess with respect to the peripheral portion, adapted to accommodate the fingers of a hand,
- whereby each of said side handles and at least one base handle is shaped to provide a gripping area by means of a hand of a user.

Preferably, the at least one base handle is formed as a further recess in said reentrant central portion.

Advantageously, the container of the invention can be lifted and placed on a dispenser with both hands, as often required by safety regulations.

Such containers are particularly heavy when filled with water and, advantageously, the side handles and the at least one base handle, or bottom handle, are useful for lifting and transporting the container, and for installing it in a water dispenser. For example, in order to lift and transport the container, a user can grasp it accommodating his hands in a respective side handle and in particular accommodating his index, middle, ring and little finger curved as a hook when the container rests on its bottom.

In addition, the position of the handles is such that the container can be carried by a person holding the container by having one hand in the side handle and the other hand in the bottom handle or both hands on the two side handles.

Furthermore, the at least one bottom handle is useful for installing the container in work position in a water dispenser, since a user can accommodate his index, middle, ring and little finger in the bottom handle.

The container, or bottle, can have a transversal cross-sectional area of various shape, like circular, square, polygonal, etc. The side handles can be positioned at various heights preferably near the mid height of the container.

Typically, each side handle is shaped substantially like number "7". In particular, each side handle is provided with a proximal surface with respect to the neck, or upper surface, and a distal surface with respect to the neck, or lower surface. Preferably, the proximal surface is inclined with respect to a plane perpendicular to the longitudinal axis Z. More preferably, the proximal surface is inclined downwards considering a direction from the side wall towards the longitudinal axis Z. The proximal surface is preferably a substantially planar surface.

The proximal and distal surface intersect at the maximum inward depth of the side handle. Preferably, the distal surface is curved and inclined with respect to a plane perpendicular to the longitudinal axis Z. More preferably, the distal surface is inclined upwards considering a direction from the side wall towards the longitudinal axis Z.

Preferably, the proximal and distal surface are joined by a curved surface which, when viewed according a cross section containing the longitudinal axis Z, in a two dimensional representation forms an inflection point, or flex, with the curved distal surface.

Advantageously, the container, and in particular the side handles and the at least one bottom handle, is shaped in order not to permit the proliferation of microorganisms, Preferably, the reentrant central portion of the bottom is concave. Preferably, the peripheral portion is substantially flat, or planar.

Preferably, the at least one bottom handle is provided in a peripheral zone, distal from the longitudinal axis Z, of the central portion. Preferably, the peripheral portion is adjacent to the lower part of the side wall of the body.

Typically, the neck is suitable for use in connection with a water dispenser.

BRIEF DESCRIPTION OF THE DRAWINGS

Further features and advantages of the invention will be apparent in view of the detailed description of a preferred, but not exclusive, embodiment, of a dispenser water container illustrated by way of non-limitative example, with reference to the accompanying drawings, in which.

The same numbers and the same letters of reference in the figures identify the same elements or components.

DETAILED DESCRIPTION OF A PREFERRED EMBODIMENT OF THE INVENTION

Figure 1:
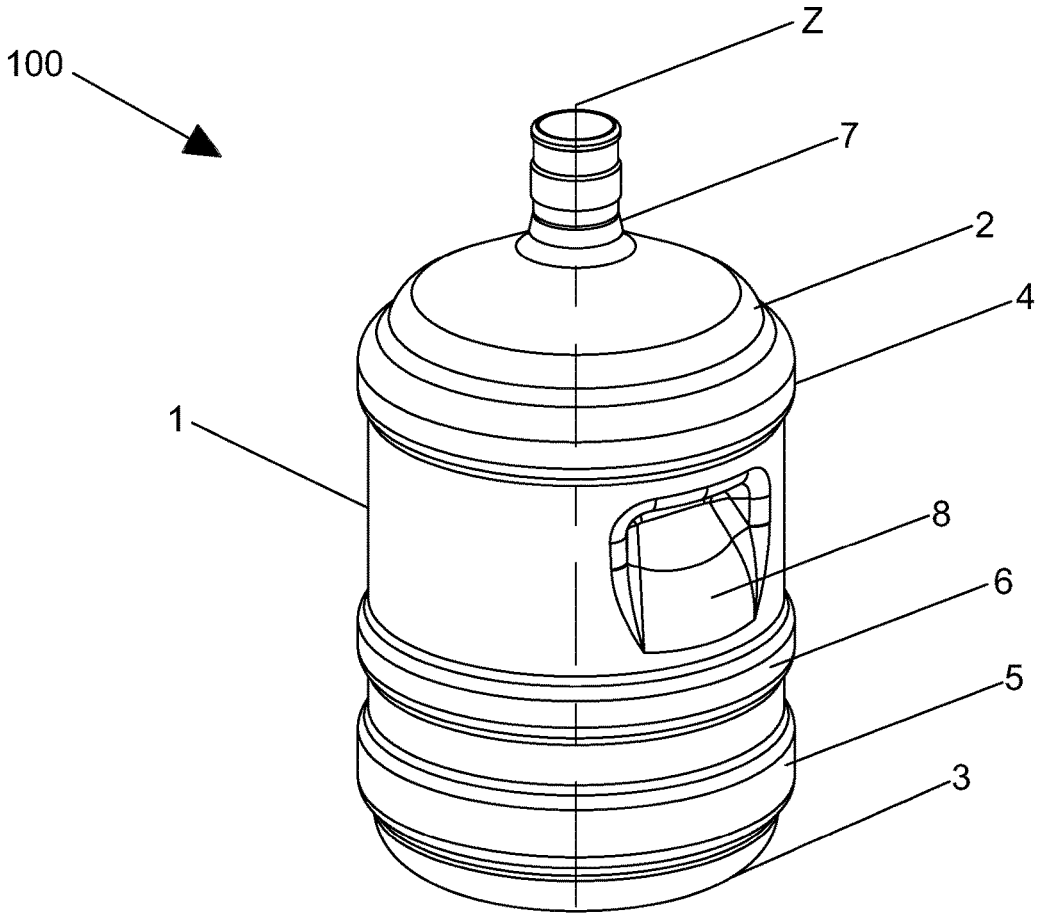
FIG. 1 shows a prospective view of the container according to the invention.
Figure 2:
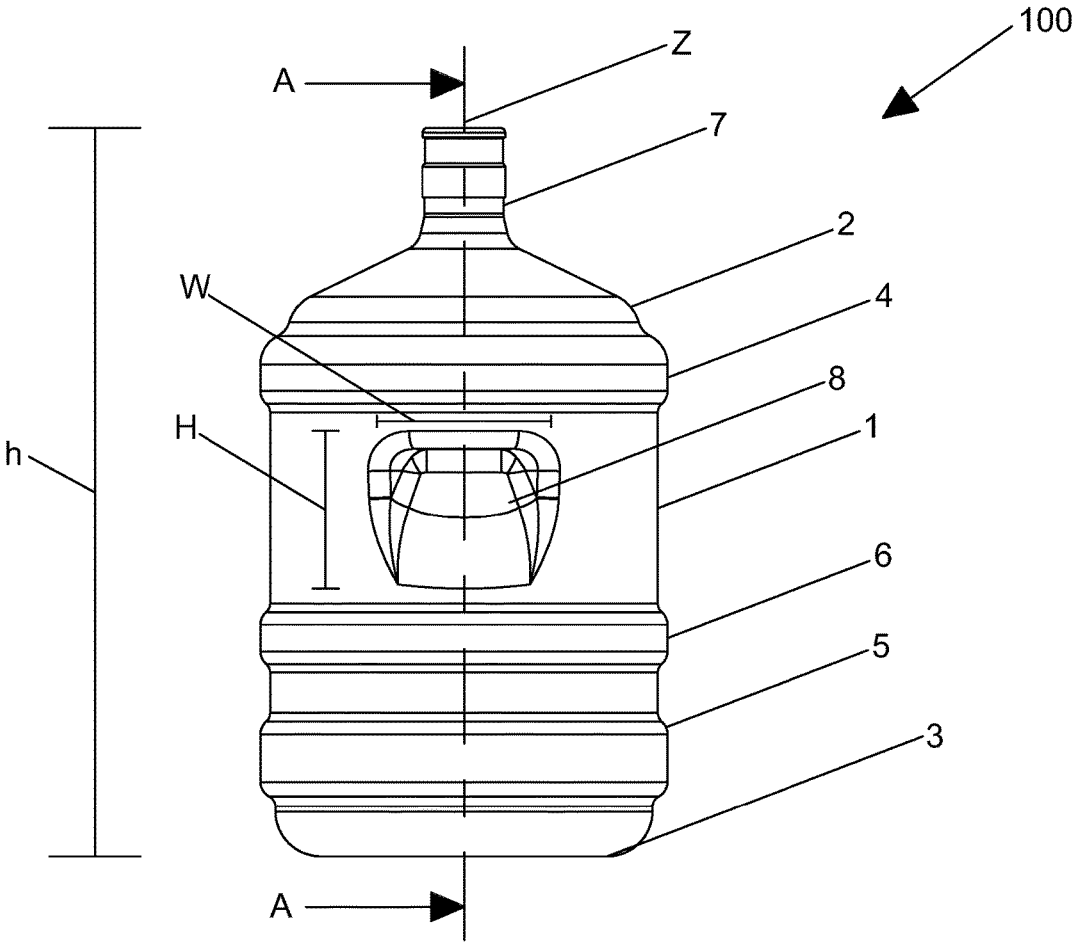
FIG. 2 shows a side view of the container according to the invention.
Figure 3:
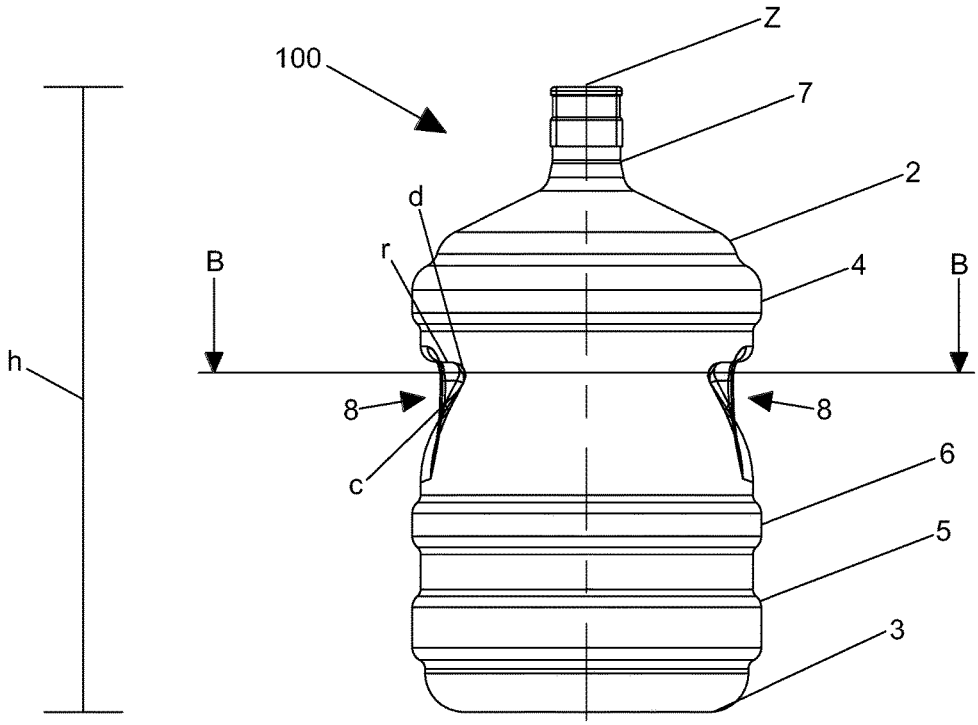
FIG. 3 shows a front view of the container according to the invention.
Figure 4:
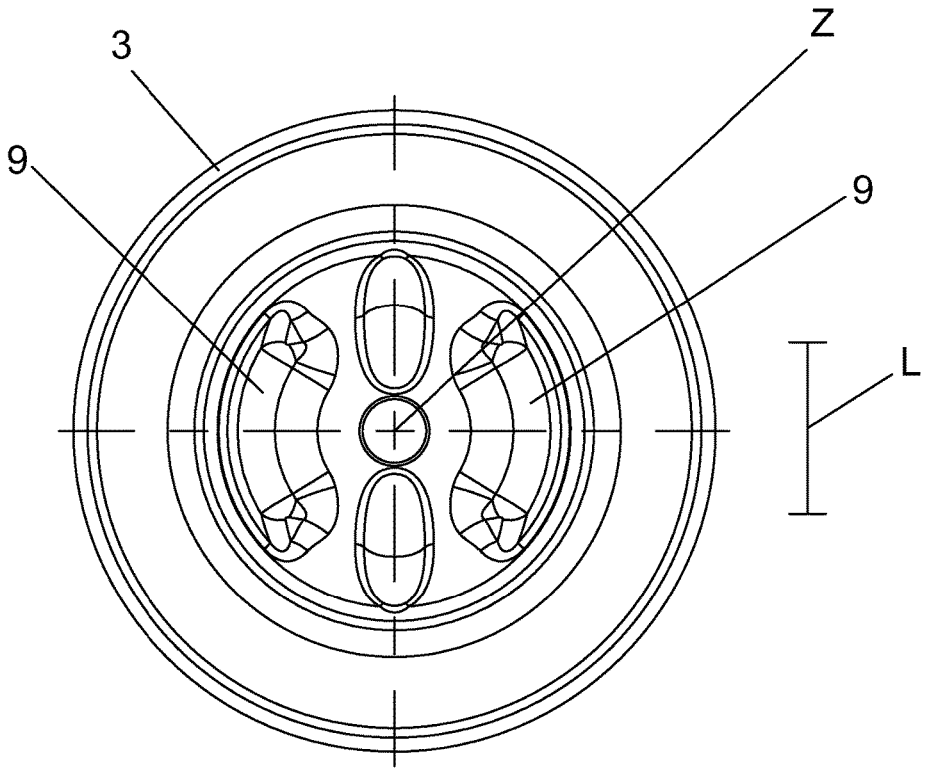
FIG. 4 shows a bottom view of the container according to the invention.
Figure 5:
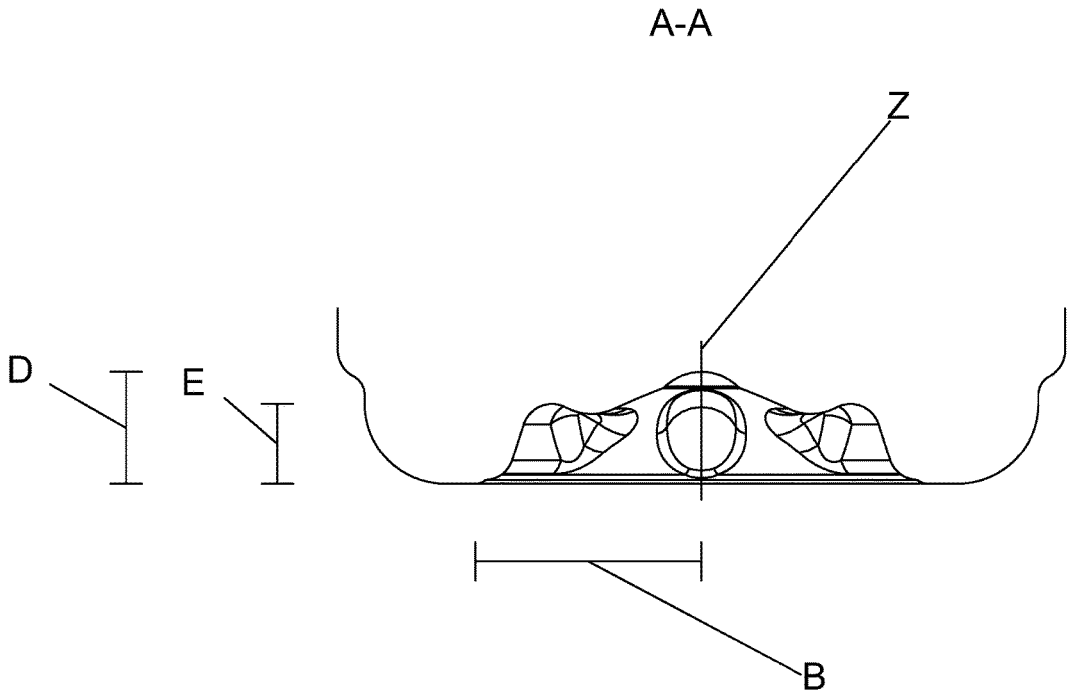
FIG. 5 shows a sectional view of the bottom of the container according to the invention.
Figure 6:
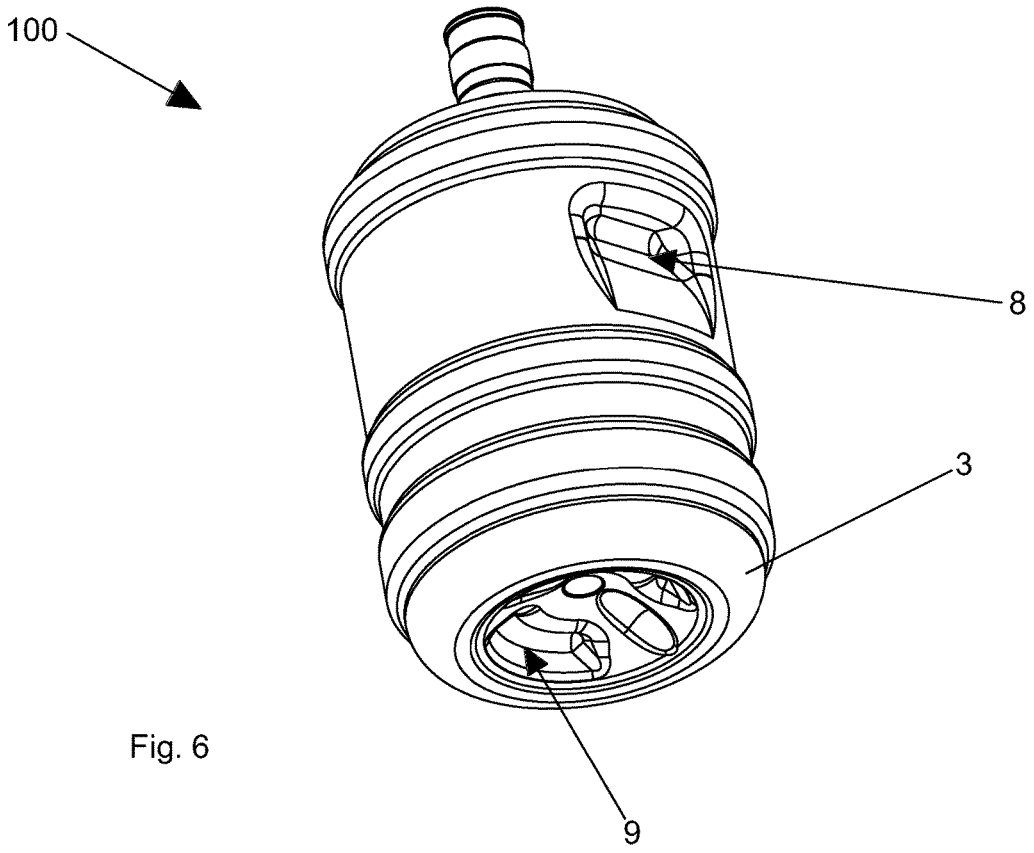
FIG. 6 shows a prospective view of the container according to the invention.

With reference to FIG. 1-6 a particularly preferred embodiment of the container 100 of the invention is described.

The container 100 is blow molded from a thermoplastic preform, preferably in PET. In this exemplary embodiment that in no way limits the scope of the invention, the container 100 comprises a body 1, a top 2, which continues with a neck 7 with an opening for pouring the water, and a bottom 3, opposite to the neck 7, that closes the container 100 at the lower end, defining a base plane. The bottom 3 comprises a flat peripheral portion coincident with the base plane and a reentrant central portion, i.e. the central portion extends inwards with respect to the base plane. Preferably, the central portion is concave, having its maximum height at its center. The body 1 has a cylindrical side wall and defines a longitudinal axis Z. Preferably, the peripheral portion is adjacent to the lower part of the side wall of the container 100. The container 100 can have transversal cross-sectional area of other types like square, polygonal, etc, without departing from the scope of the invention. The neck 7 is coaxial with the longitudinal axis Z. A peripherally protruding upper ring 4, that is a protruding upper portion, having a flat side wall is provided between the top 2 and the body 1. A peripherally, or radially, protruding lower ring 5, that is a protruding lower portion, is provided between the body 1 and the bottom 3. A peripherally protruding intermediate ring 6, that is a protruding intermediate portion, is provided between the upper and lower ring 4, 5 at a distance from the lower ring 5 that is smaller than its distance from the upper ring 4. The protruding rings 4, 5, 6 have flat cylindrical side wall and external diameter slightly bigger than the diameter of the external surface side wall of the body 1. The protruding rings 4, 5, 6 are provided with upper and lower transition truncated-conical surfaces. The protruding rings 4, 5, 6 have the main scope to avoid damage to the side wall of the body 1 especially when more containers are packed together. The top 2 of the container 100 has a general truncated-conical surface that tapers upwards from the protruding upper ring 4 towards the circular neck 7. This type of container 100 can contain from 10 up to 20-25 liters of water. For lifting and transporting the container 100 in a simple and easy way, at least two side handles 8, preferably two side handles 8, formed as recesses in the side wall of the body 1, are provided. In other words, the side handles 8 extend inwards with respect to the outer surface of the body 1. The side handles 8 provide places into which a user can place the four fingers of his hands, typically except the thumb. Preferably, the side handles 8 have same size and shape and are preferably arranged opposite to each other, symmetrically with respect to the longitudinal axis Z and, more preferably, between the protruding upper ring 4 and the protruding intermediate ring 6. Preferably, the container of the invention has a volume capacity of or above 10 L, more preferably comprised between 12 and 25 L, for example a volume capacity of about 19 liters. Preferably, the center of the side handle 8 is positioned between 50% and 65%, more preferably between 54% and 60% of the total height h, along the longitudinal axis Z, of the container 100. Preferably, the height h of the container 100 from the base plane to the top of the neck is about 48.7 cm. Preferably, but not exclusively, the container has a maximum width along a direction perpendicular to its longitudinal axis Z comprised between about 20 cm and about 30 cm. For example, the container can have a maximum diameter comprised between about 25 cm and about 28 cm, for example of about 27.15 cm. The side handles 8 are designed to facilitate the insertion of a hand but also the flow of liquid during the washing cycles in order not to permit the proliferation of microorganisms. Preferably, the shape of each side handle 8 in a transversal cross section perpendicular to the longitudinal axis Z, follows a circle coaxial with the body 1, while the side handles 8 when viewed according to a cross section containing the longitudinal axis Z forms an arc of circle "c", having a radius that is between 66% and 81%, more preferably between 70% and 77% of the radius of the cylinder representing the body 1. Said arc of circle "c" starts at the surface of the side wall of the body 1 near the intermediate ring 6 and continues inwards towards the upper ring 2 till reaching a maximum depth, from which the surface of the side handle 8 folds back following a curved line "d" and reaches again the side wall of the body 1 with a straight line "r", slightly inclined with respect to a plane perpendicular to the longitudinal axis Z.

The maximum depth of each side handle 8 is comprised between 20% and 40%, preferably between 25% and 35% of the radius of the body 1. The inclination of the straight line "r", i.e. the inclination of the upper surface of the side handle 8, in respect of a plane perpendicular to the longitudinal axis Z, is between 1.5° and 2.5°, preferably between 1.8° and 2.2°. The upper surface of the side handle 8 is used for lifting the container 100. The height H, along the longitudinal axis Z, of each the side handle 8 is between 20% and 25%, preferably between 21% and 24%, of the total height h of the container 100, while the width W, along a plane perpendicular to the longitudinal axis Z, is comprised between 30% and 45% of the diameter of the body 1, preferably between 35% and 40% of said diameter. The central portion of the bottom 3 comprises at least one bottom handle 9, preferably two bottom handles 9, formed as further recesses in the central portion. The bottom handles 9 are shaped to provide a gripping area by means of a hand of a user which can accommodate his fingers, typically except the thumb, therein. Preferably, the bottom handles 9 are aligned to the side handles 8, and have, preferably, same size and shape. Preferably, the bottom handles 9 are diametrically opposed to each other with respect to the longitudinal axis Z and are placed at the same distance from the longitudinal axis Z. Preferably, each bottom handle 9 designs, on a projection of the central portion on a plane perpendicular to the longitudinal axis Z, an annular sector with the center on the longitudinal axis Z where the radius B of the external circumference of this annular sector, is comprised between 48% and 55%, preferably between 50 and 53%, of the radius of the body 1. The extension L, along a direction orthogonal to the longitudinal axis Z, of each annular sector is comprised between 50% and 58%, preferably between 52% and 55% of the radius of the body 1. The depth E, along the longitudinal axis Z, of the bottom handles 9 is between 65% and 75%, preferably between 68% and 72%, of the maximum depth D, along the longitudinal axis Z, of the bottom 3. The position of the side handles 8 and of the bottom handles 9, is such that the container 100 can be carried, for example, by a person holding it by having one hand in one of the side handle 8 and the other hand in one of the bottom handle 9, or both hands in the side handles 8, or one hand in the bottom handle 9 and one hand holding the neck. The side handles 8 and the bottom handles 9 are conveniently formed during the blowing process of the production of the container. The side handles 8 and the bottom handles 9 are designed to provide an optimal grip of the container, especially when the container must be lifted or transported and for rendering these operations as least cumbersome as possible. When the container has to be handled, the bottom handles 9 provide an easy leverage having the leverage point on the side handle 8. The invention has been described in a preferred embodiment, but it must be understood that the invention is not limited to this specific embodiment, and modifications may be made without departing from scope of the invention.

The invention claimed is:

1. A thermoplastic material container (100) for a water dispenser, having a volume capacity comprised 12 and 25 liters, defining a longitudinal axis (Z), comprising:

a neck (7), a body (1) having a side wall, at least two side handles (8) arranged opposite to each other with respect to the longitudinal axis (Z), each formed as a recess in said side wall having a surface proximal to the neck (7) substantially transversal to the longitudinal axis (Z), each adapted to accommodate the fingers of a hand of a user, to lift the container (100) vertically, a bottom (3) closing the container (100) at its lower end, defining a base plane, comprising a peripheral portion forming a planar base, a central portion reentrant with respect to the peripheral portion, and;

at least one base handle (9) formed as a recess with respect to the peripheral portion, adapted to accommodate the fingers of a hand, wherein each side handle (8) has a height (H), along the longitudinal axis (Z), between 20% and 25% of a total height (h) of the container (100), and a width (W), along a plane perpendicular to the longitudinal axis (Z), comprised between 30% and 45% of the diameter of the body (1), whereby each of said side handles (8) and at least one base handle (9) is shaped to provide a gripping area by means of a hand of a user.

2. A container (100) according to claim 1, having at least two base handles (9).

3. A container (100) according to claim 2, having two side handles (8) and two base handles (9).

4. A container (100) according to claim 2 or 3, wherein each side handle (8) is aligned with a respective base handle (9).

5. A container (100) according to any of the preceding claims, wherein the body (1) has circular cross section.

6. A container (100) according to any one of the preceding claims, wherein said side handles (8) and base handles (9) are formed during the blowing process by a deformation of the wall of said container (100).

7. A container (100), according to any one of the preceding claims, having a peripherally protruding upper portion (4) and a peripherally protruding lower portion (5) with respect to the body (1).

8. A container (100) according to any one of the preceding claims, wherein the side handles (8) are arranged at a height from the base plane of the container (100) corresponding to 50%-65%, more preferably between 54%-60%, of the total height (h) of said container (100).

9. A container (100) according to any of the preceding claims, wherein the depth (E) of the base handles (9) is comprised between 65% and 75%, more preferably between 68% and 72% of the maximum depth (D), along the longitudinal axis (Z), of the bottom (3).

10. A container (100) according to any one of the preceding claims, wherein the transversal cross sections perpendicular to the longitudinal axis of each side handle (8) has substantially the shape of arcs of circle, and the longitudinal cross sections that comprise the longitudinal axis (Z) have the shape of an arc of circle (c) having a radius that is between 66% and 81%, more preferably between 70% and 77% of the radius of said body (1), said arc of circle (c) starting from a first plane of the surface of the body (1) proximal to the bottom (3) and terminating, at a point of maximum depth, at a plane of the outer surface that is distal from the bottom (3), after said point the surface of the handle (8) folds back following a curved line (d) and reaches the side surface of the main body (1) following an inclined straight line (r).

* * * * *